United States Patent [19]

Kuhlmann et al.

[11] Patent Number: 4,621,002

[45] Date of Patent: Nov. 4, 1986

[54] MONOCOQUE STRUCTURE FOR AN AQUATIC SPORTSCRAFT

[75] Inventors: Werner Kuhlmann, Westerndorf-Stephanskirchen; Heinrich Uphoff, Aschau, both of Fed. Rep. of Germany

[73] Assignee: Kleeper Beteilingungs GmbH & Co. Bootsbau KG, Rosenheim, Fed. Rep. of Germany

[21] Appl. No.: 638,281

[22] Filed: Aug. 3, 1984

[30] Foreign Application Priority Data

Aug. 8, 1983 [DE] Fed. Rep. of Germany ..... 3328596

[51] Int. Cl.[4] ..... B32B 27/08

[52] U.S. Cl. ..... 428/71; 428/76; 428/308.4; 428/319.7; 428/332; 428/480; 428/521; 441/74

[58] Field of Search ..... 428/480, 308.4, 317.9, 428/319.7, 521, 332, 71, 76, 308.4; 441/74

[56] References Cited

FOREIGN PATENT DOCUMENTS

| | | | |
|---|---|---|---|
| 2829380 | 1/1980 | Fed. Rep. of Germany | 441/74 |
| 2850342 | 5/1980 | Fed. Rep. of Germany . | |
| 3146381 | 6/1983 | Fed. Rep. of Germany . | |
| 2523035 | 9/1983 | France | 441/74 |
| 597032 | 3/1978 | Switzerland . | |

*Primary Examiner*—Paul J. Thibodeau
*Attorney, Agent, or Firm*—Irvin A. Lavine

[57] ABSTRACT

A monocoque structure for aquatic sportscraft comprising at least two layers of coextruded thermoplastic materials, a first layer of which prevalently consists of a thermoplast from the group of linear polyesters, preferably polycarbonates, and a second layer of which prevalently consists of a thermoplast from the group of polystyrene derivatives, the wall thicknesses of said layers being 0.08 to 0.3 mm and 0.8 to 1.5 mm, respectively, the outermost first layer having light-absorbent and/or light-reflecting properties.

8 Claims, 1 Drawing Figure

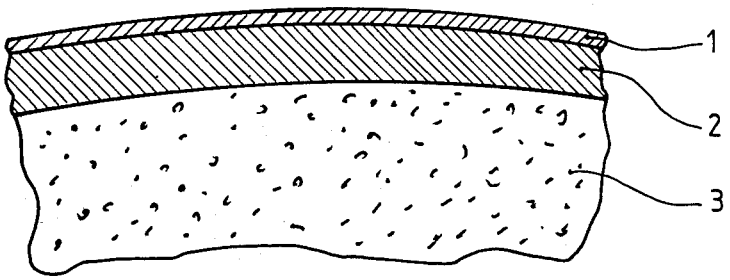
1
2
3

MONOCOQUE STRUCTURE FOR AN AQUATIC SPORTSCRAFT

DESCRIPTION

The present invention relates to a monocoque structure for aquatic sports craft according to the generic clause of claim 1, and to a method for making such structure.

It is already known to form the surface layer of a monocoque structure of several constituent layers in order to make the outermost surface as hard and scratch-resistant as possible while imparting the required resiliency to the surface layer as a whole. Known from DE-OS No. 28 50 342 is a surfboard body having a core of a foamed material onto which a layer of polyurethane is sprayed, cured and then covered by a polyester layer likewise applied thereonto by the spray method.

DE-GM No. 75 34 898 discloses a surfboard body, in which a layer enveloping a core of a foamed material consists of an outermost layer formed of a polyurethane varnish superimposed upon one or several layers of polyurethane integral foam. The layered structure in this case is obtained by painting or spraying the individual layers one after the other into a negative mould.

These known laminating methods require a considerable amount of labour and result in layers the thickness of which cannot be kept constant with desirable accuracy. These methods are therefore scarcely suitable for production on an industrial scale.

From DE-OS No. 31 46 381 it is already known to form the shell of surfboard bodies by initially producing a sheet of a thermoplastic material by an extrusion process and by subsequently forming the sheet material to the desired shape in a hot forming process. Although it was possible to steadily improve the desired properties of such shell structures by proper selection and modification of the materials employed, it appeared impossible to achieve any further reduction of the weight of the shell structure while retaining or even improving its phsical properties such as surface hardness, impact strength and resiliency. The use of heat-formed sheets of polystyrene derivatives for monocoque structures of aquatic sports craft requires such sheets to have an initial wall thickness of at least 2.2 to 2.5 mm, as the physical properties of the thermoplastics, such as their bending strength, their E modulus, their impact strength and their notch toughness do not allow the thickness to be reduced further. An average surface area for instance of a wind surfboard of 4.5 $m^2$ and a sheet thickness of 1.8 to 2.5 mm thus results in a monocoque structure having a relatively heavy weight of 10.4 to 11.7 kg. It has already been tried to employ thermoplastics having better specific strength properties in order to reduce the weight of the monocoque structure. Experiments carried out with linear polymers such as PC (polycarbonate), PETP (polyethylene terephthalate), PBTP (polybutylene terephthalate) and PA6 (polyamide 6) were unsuccessful due to the fact that these materials have insufficient and unacceptable heat-forming properties, offer considerable difficulties with respect to bonding or welding and require the use of heat-forming dies capable of being accurately temperature-controlled at temperatures above 100° C. In addition, the heat-forming temperature has to be maintained within a range of ±2° C., as these synthetic materials change from a hard solid state to the liquid state within a very narrow temperature range. As a result, normally equipped heat-forming machines and conventional heat-forming dies made of wood or epoxy resins cannot be employed, so that one has to resort to considerably more expensive equipment. A further difficulty is presented by the fact that these synthetics are subject to a strong shrinkage of 2 to 4%, so that during the customary positive forming process the formed bodies shrink onto the die, resulting in forming problems particularly adjacent reentrant portions such as drop-keel casings and fin casings. Although polycarbonates are more attractive than polystyrene derivatives due to their specific strength properties, they suffer from a tendency to develop tension crack corrosion when contacted with tar, gasoline or conventional cleaning liquids.

It is thus an object of the present invention to provide a monocoque structure for an aquatic sportscraft of the type defined in the introduction, which is capable of being produced with the required mechanical properties and with its weight reduced as far as possible while maintaining sufficient strength. In particular, the monocoque structure should have the resistance to atmospheric conditions required for an aquatic sportscraft.

The subject matter of the invention proceeds from the recognition that a layered structure of a linear polymer and a coextruded polystyrene derivative, in which the wall thicknesses of the linear polymer and the polystyrene derivative layer are between 0.08 to 0.3 mm and 0.8 to 1.8 mm, respectively with the additional provision that the layer formed of the linear polymer is to have light absorbing and/or light reflecting properties, does not offer undue problems with regard to its production and handling while being resistant to atmospheric conditions. Irrespective of the widely different melting temperatures, of the different response to being heated and of the different heat expansion and contraction values of the two layers, the layered structure is capable of being readily maintained in the heat-forming process, permitting it to be formed into a monocoque structure imparting superior properties to an aquatic sportscraft. The linear polymer employed for imparting the required surface finish and form-retaining properties to the monocoque structure are extremely hard, glossy and scratch-resistant, while the polystyrene derivatives have excellent bending elasticity and toughness. These properties enable the wall thickness of the monocoque structure to be remarkably reduced, resulting in a reduction of the weight of the monocoque structure for a wind surfboard by up to 50%, while the mechanical properties are even still further improved by comparison to a single-layered structure formed of a polystyrene derivative. This leads not only to reduced production expense due to a saving of material, but also to a weight reduction of up to 5 kg in the case of a surfboard having considerably improved surfing properties. It has also been found that irrespective of all fears regarding the use of polycarbonate as the outermost layer there occurs no tension crack corrosion. The insufficient resistance to atmospheric conditions of comparable layered structures has been found to obviously have been due to the fact that light, particularly ultraviolet radiation, penetrating the surface layer has adverse effects on the bond between the two layers.

The relative dimensioning of the wall thicknesses of the two constituent layers results in a particularly good bond and superior heat-forming properties of the layered structure.

In certain instances, it is desirable to form the fist layer such that it has variable thickness transverse to the direction of extrusion, the thickness being greatest at the center between lateral edges and steadily decreasing towards said lateral edges to about 50% of said greatest thickness. Particularly in the case of wind surfboards, the heaviest mechanical loads are encountered in the vicinity of the central stepping area, so that this portion of the board has to be strongest and is usually provided with a roughened surface, while the greatest loads during the heat-forming process are encountered in the vicinity of the lateral edges. These two factors are taken into account in a particularly simple manner by the selection of a surface layer the wall thickness of which decreases towards the lateral edge portions, resulting in the central portion of the monocoque structure being suitably strengthened while the problems posed by the heat-forming process are largely reduced.

The expansion of the second layer permits a further weight reduction of the monocoque structure to be achieved, the compatibility and the bonding strength between the two constituent layers to be further improved, and an improved bonding strength between the monocoque structure and a foam material core to be enclosed therein to be achieved.

Providing an admixture of up to 35% by weight of the composition of one layer into the other layer results in a still further improved bonding strength between the two constitutent layers, it being preferable to provide only the polystyrene derivative layer with an admixture of linear polyester and to employ solely linear polyester for the outermost surface layer so as to maintain the excellent surface properties thereof. A further advantage resulting from this provision consists in that it enables scrap materials from previously coextruded structures to be effectively re-used.

The addition of strenghtening materials such as glass fibers, glass threads, glass fiber mats or structures formed thereof serve the further improvement of the physical properties of the layered structure, particularly the toughness and tensile strength thereof.

The invention shall now be explained in detail with reference to an embodiment thereof shown in the drawing.

The single FIGURE of the drawing shows a portion of a wind surfboard consisting of a one- or two-piece monocoque structure formed by a deep-drawign process and having a layered structure consisting of a first layer 1 and a second layer 2. The hollow interior of the monocoque structure is filled with a polyurethane foam 3 expanded in situ. First layer 1 (the outer layer) consists of a linear thermoplastic polymer such as PC (polycarbonate), PETP (polyethylene terephthalate), PBTP (polybutylene terephthalate) or PA6 (polyamide 6), preferably of PC or PBTP having a layer thickness of 0.08 to 0.3 mm, preferably 0.2 mm. The second layer 2 (inner layer) consists of a thermoplastic polystyrene copolymer with another ethylenically unsaturated monomer such as BS (butadienestyrene), ABS (acrylonitrile butadiene styrene), ASA (acrylonitrile styrene-acrylic ester) or SAN (styrene-acrylonitrile) having a layer thickness of about 0.8 to 1.8 mm, preferably 1.2 to 1.6 mm. The foregoing constituents are preferred. The two thermoplastics have been simultaneously extruded in a and bonded to one another immediately after having been so extruded and while still in the plastic state, preferably by the application of pressure by means for instance of pressure rollers, the resultant layered material having subsequently been formed to the desired shape of the monocoque structure by a heat-forming or molding process. Both layers 1 and 2 formed of the respective thermoplastics, may include admixtures of up to 35% by weight of the respective other thermoplastic, it being preferred, however, to employ such admixture only in one of the layers. There is also the possibility to employ not the identical, thermoplastic of the other layer as an admixture of the Y or X thermoplastic of the one layer, but rather another thermoplastic from the two groups in question. It is essential that layer 1 is made as opaque as possible, while may be achieved by various provisions and combinations thereof. According to one such provision, the X thermoplastic of layer 1 is mixed with a light-absorbent pigment prior to extrusion. Suitable for this purpose are white pigments such as titanium dioxide, carbon black, or coloured pigments of UV-light absorbers and mixtures thereof. Provided as an alternative is the inclusion of light-scattering particles for increasing the length of the light path in layer 1 so as to result in an increased absorption of the light. According to a still further provision, the outer surface of layer 1 may be printed or coated with a light-absorbent or light-reflecting material.

As already explained above, first and second layers 1 and 2, respectively, are extruded simultaneously and bonded to one another in the form of flat sheets while still in their plastic state. The bonding process is accomplished by causing a reactive gas, such as oxygen, ozone, chlorine or mixtures of these gases with nitrogen, to flow over the surfaces to be bonded to one another, and by passing the sheets through a gap between parallel pressure rollers for compression therebetween with a pressure of for instance 2 to 12 kp/cm$^2$. Several pairs of such rollers may be provided in series for counteracting any shrinkage or warping caused by cooling of the materials. Since the linear polymer layer 1 leaves the extrusion die at a higher temperature than the polystyrene derivative layer 2, and both materials come into contact with one another while still in their plastic state, it is preferred to heat layer 1 on its way from the extrusion die to the bonding location, or even at the bonding location itself. This may be accomplished in a conventional manner by means of heated guiding or pressure rollers. Radiators or heated gasses may also be contemplated for the heating process.

For modifying the mechanical properties of the layered structure, the constituent layers may contain strenghtening reinforcement materials such as glass fibers, glass threads or structures composed thereof, such materials being conventionally embedded only in the second layer 2, in order to reinforce this layer, which is orginally softer than the first layer of a linear polymer, and to avoid adverse effects on the superior surface properties, such as brilliance and smoothness, of the surface layer, particularly polycarbonate layer. In general, the layered structure may also consist of a twofold array of layers 1 and 2, or of two first layers 1 with a single second layer 2 sandwiched therebetween.

The second layer 2 of a polystyrene derivative may be fully or partially expanded so as to reduce the weight of the monocoque structure and to improve the bonding properties with regard to adjacent layers.

Since the drawing shows only a portion of the body of a wind surfboard, it is not evident therefrom that first layer 1 is of varying thickness over the width of the surfboard body. In the central area along the longitudinal axis of the surfboard body the thickness is 0.3 mm, steadily decreasing to 0.15 mm in the lateral direction.

In the case of a wind surfboard having a length of 3650 mm, a width of 690 mm and a volume of about 220 liters, a wall thickness of the monocoque structure according to the invention of 1.2 to 1.5 mm was sufficient, at a total weight of 16.5 kg, to obtain an equivalent stiffness as in the case of a surfboard having a single-layer polystyrene shell structure with a wall thickness of 1.9 to 2.5, at a total weight of 19.5 to 22 kg, the foam material core and other components being the same in both cases. For testing the behaviour of the craft under the impact of waves on the forward portion, the forward portion of surfboards was subjected to a load increasing from 50N to 500N. The deformation was measured in short and long duration tests. As a result it was found that the surfboard made in accordance with the invention is considerably more rigid than comparative surfboards.

In oscillation tests and sailing tests the surfboards made in accordance with the invention were found to have better stability and resistance to oscillations, and the testers got the impression of better maneouverability, improved behaviour with regard to getting under way, and higher speed. For assessing the practical behavior of the craft under impact and shock loads, use was made of the drop test method. It was found that in the case of the conventional single-layer structure made of polystyrene derivatives, the empirically determined sufficient impact strength of 30 kp/m$^2$ was achieved with a wall thickness of at least 2.5 mm, while in the case of the structure according to the invention, this limit value is already exceeded with a wall thickness of 1.8 mm and a thickness of the PC layer of 0.2 mm.

In the above description, reference is made only to a wind surfboard as an aquatic sportscraft for which the described layered structure is suitable. Further aquatic sportscraft for which this layered structure is suitable include boat hulls for jolly boats, catamarans, kayaks and canoes.

We claim:

1. A monocoque structure for aquatic sportscraft comprising a sheet of a thermoplastic material including at least two constituent layers bonded to one another, characterized in that the two constituent layers (1, 2) are extruded and bonded to one another immediately after extrusion while still in their plastic state, the first polymer layer (1) comprising a thermoplastic polymer from the group consisting of linear polyesters and polyamides and the second layer (2) comprising a thermoplastic polystyrene copolymer, said first layer (1) having a thickness of about 0.08 to 0.3 mm and said second layer (2) having a thickness of about 0.8 to 1.8 mm, said first layer (1) being opaque to light, said sheet being hot-molded into a hollow shell; and a foam core foamed in situ within said shell.

2. A monocoque structure according to claim 1, characterized in that the thickness of said second layer (2) is about eight times that of said first layer (1).

3. A monocoque structure according to claim 1, characterized in that said first layer (1) is formed with a variable thickness transverse to the direction of extrusion, said thickness being greatest at the center between lateral edges and steadily decreasing towards said lateral edges to about 50% of said greatest thickness.

4. A monocoque structure according to claim 1, characterized in that the density of said second layer (2) is reduced by expansion during extrusion to about 90% to 50% of its density in an unexpanded state.

5. A monocoque structure according to claim 1, characterized in that said first layer (1) comprises PC (polycarbonate), PETP (polyethylene terephthalate), PBTP (Polybutylene terephthalate) or PA6 (polyamide 6).

6. A monocoque structure according to claim 1, characterized in that said second layer (2) comprises BS (butadiene styrene), ABS (acrylo-nitrile butadiene styrene), ASA (acrylo-nitrile styrene acrylic ester) or SAN (styrene acrylo-nitrile).

7. A monocoque structure according to claim 1, characterized in that said first layer (1) includes up to 35% by weight of a thermoplastic of the group of layer 2 said second layer (2) contains up to 35% by weight of a thermoplastic of the group of layer 1.

8. A monocoque structure according to claim 1, characterized in that at least one of said first layer (1) and said second layer (2) contains a strengthening material selected from the group consisting of glass fibers, glass threads, glass fiber mats, and structures formed thereof.

* * * * *